US008800310B2

(12) United States Patent
Sugitani

(10) Patent No.: US 8,800,310 B2
(45) Date of Patent: Aug. 12, 2014

(54) TURBO COMPRESSOR AND REFRIGERATOR

(75) Inventor: Noriyasu Sugitani, Yokohama (JP)

(73) Assignee: IHI Corporation (JP)

( * ) Notice: Subject to any disclaimer, the term of this patent is extended or adjusted under 35 U.S.C. 154(b) by 1221 days.

(21) Appl. No.: 12/365,368

(22) Filed: Feb. 4, 2009

(65) Prior Publication Data

US 2009/0193845 A1 Aug. 6, 2009

(30) Foreign Application Priority Data

Feb. 6, 2008 (JP) ..... P2008-027071

(51) Int. Cl.
*F25B 1/00* (2006.01)
*F25B 49/00* (2006.01)
*F25B 1/10* (2006.01)

(52) U.S. Cl.
USPC ..... 62/228.4; 62/498; 62/502; 62/510; 415/100; 415/116

(58) Field of Classification Search
USPC ..... 165/228.4, 402, 469, 498, 502, 510; 415/100, 116; 62/228.4, 402, 469, 498, 62/502, 510
See application file for complete search history.

(56) References Cited

U.S. PATENT DOCUMENTS

| | | | | |
|---|---|---|---|---|
| 2,786,626 | A | 3/1957 | Redcay | 230/209 |
| 3,496,992 | A * | 2/1970 | Leonard, Jr. | 62/502 |
| 3,728,857 | A * | 4/1973 | Nichols | 62/469 |
| 4,432,212 | A * | 2/1984 | Tachibana et al. | 62/228.4 |
| 5,172,753 | A * | 12/1992 | Kadle et al. | 62/402 |
| 5,709,103 | A * | 1/1998 | Williams | 62/402 |
| 6,592,654 | B2 * | 7/2003 | Brown | 95/270 |
| 6,675,594 | B2 * | 1/2004 | Choi et al. | 62/197 |
| 7,451,616 | B2 * | 11/2008 | Ro | 62/505 |
| 8,245,530 | B2 * | 8/2012 | Sugitani | 62/498 |
| 8,567,207 | B2 * | 10/2013 | Sommer et al. | 62/228.1 |
| 8,627,680 | B2 * | 1/2014 | Haley et al. | 62/498 |
| 2007/0147984 | A1 | 6/2007 | Takahashi et al. | 415/100 |

FOREIGN PATENT DOCUMENTS

| | | |
|---|---|---|
| JP | 62-179 | 1/1987 |
| JP | 1-147199 | 6/1989 |
| JP | 2004-300928 | 10/2004 |
| JP | 2007-177695 | 7/2007 |
| JP | 2007-212112 | 8/2007 |

OTHER PUBLICATIONS

Office Action dated May 29, 2012 issued in corresponding Japanese Patent Application No. 2008-027071 with English translation (4 pages).

* cited by examiner

*Primary Examiner* — Ljiljana Ciric
(74) *Attorney, Agent, or Firm* — Ostrolenk Faber LLP

(57) ABSTRACT

A turbo compressor to suction and compress gas includes a housing including a flow passageway through which gas flows, an impeller disposed inside the flow passageway, the impeller providing suction for the gas by being rotationally driven, a liquid discharge port provided in the flow passageway on the upstream side of the impeller, the liquid discharge port discharging, from the flow passageway, any liquid produced as the gas liquefies when the turbo compressor is stopped, a liquid discharge pipe connected to the liquid discharge port, an electromagnetic valve connected to the liquid discharge pipe, and a controller configured to open the electromagnetic valve before the impeller is rotationally driven. A refrigerator includes the turbo compressor, wherein the turbo compressor compresses refrigerant gas.

8 Claims, 5 Drawing Sheets

TURBO COMPRESSOR AND REFRIGERATOR

BACKGROUND OF THE INVENTION

1. Field of the Invention

The present invention relates to a turbo compressor capable of compressing a liquid by a plurality of impellers, and a refrigerator including the turbo compressor.

Priority is claimed on Japanese Patent Application No. 2008-027071, filed Feb. 6, 2008, the content of which are incorporated herein by reference.

2. Description of the Related Art

As refrigerators which cool or freeze objects to be cooled, such as water, a turbo refrigerator or the like including a turbo compressor which compresses and discharges a refrigerant by impellers is known.

In a compressor, when a compression ratio increases, the discharge temperature of the compressor becomes high and the volumetric efficiency thereof degrades. Thus, in the turbo compressor included in the above-mentioned turbo refrigerator or the like, a refrigerant may be compressed in a plurality of stages. For example, a turbo compressor which includes two compression stages provided with an impeller and a diffuser and compresses a refrigerant sequentially in these compression stages is disclosed in Japanese Patent Unexamined Application, First Publication No. 2007-177695.

Meanwhile, in this type of turbo compressor, a liquid pool may be formed at a bottom of a flow path through which a refrigerant gas or the like circulates, as the refrigerant gas filled into the turbo compressor during standby of the turbo refrigerator is liquefied depending on the conditions of outside air temperature. When the turbo refrigerator is started in this state, the liquid is sucked by the turbo compressor and collides against the impeller. As a result, an excessive power load acts on the impeller. Fatigue breaking of the impeller by liquid colliding may occur by repeating such starting and standby of such a turbo refrigerator. Additionally, even if the impeller does not lead to breaking, problems may occur such as the surface roughness of impeller vanes degrading by the collision of the liquid, and the compression performance degrades.

SUMMARY OF THE INVENTION

In view of the above problems, an object of the present invention is to provide a refrigerator including a turbo compressor capable of preventing fatigue breaking of an impeller and capable of controlling degradation of the compression performance of the impeller.

In order to solve the above problems, the turbo compressor of one aspect of the present invention includes: an impeller which is rotationally driven; and a flow path in which the impeller is provided, and through which gas flows, the turbo compressor sucking and compressing the gas in the flow path. The turbo compressor further includes a fluid discharge device which discharges a liquid in the flow path on the upstream side of the impeller.

By adopting such a configuration, in the present invention, the liquid is discharged and removed in advance in the upstream flow path which leads to the impeller. As a result, any collision of the liquid pooled in the flow path against the impeller can be prevented.

Additionally, in the present invention, a configuration in which the liquid is the gas which is liquefied may be adopted.

By adopting such a configuration, in the present invention, the liquid generated according to the conditions of outside air temperature can be discharged.

Additionally, in this invention, a configuration in which the fluid discharge device has a fluid discharge pipe which is connected to the flow path and allows the liquid to be discharged therethrough, an electromagnetic valve connected to the fluid discharge pipe, and a controller which open and close the electromagnetic valve may be adopted.

By adopting such a configuration, the control of either discharging or not discharging the liquid through the fluid discharge pipe, by the opening/closing of the electromagnetic valve can be performed.

Additionally, in the present invention, a configuration in which the controller opens the electromagnetic valve before the impeller is rotationally driven may be adopted.

By adopting such a configuration, in the present invention, the liquid can be discharged to preferably prevent the liquid from colliding against the impeller before the impeller is rotationally driven to suck the liquid.

Additionally, in the present invention a configuration may be adopted which further includes: a plurality of compression stages each having the impeller; a second flow path which connects the first compression stage and a second compression stage and is formed around a horizontal axis, wherein the fluid discharge pipe is provided at a bottom position of the second flow path.

By adopting such a configuration, in the present invention, the liquid can be discharged from positions which become the bottom of the second flow path formed around the horizontal axis where the liquid tends to pool, and thereby, any collision of the liquid against the impeller of the second compression stage can be prevented.

Additionally, in another aspect of the present invention, in a refrigerator including a condenser which cools and liquefies a compressed refrigerant, an evaporator which evaporates the liquefied refrigerant and deprives vaporization heat from an object to be cooled, thereby cooling the object to be cooled, and a compressor which compresses the refrigerant evaporated in the evaporator and supplies the refrigerant to the condenser, a configuration in which the turbo compressor is used as the compressor is adopted.

By adopting such a configuration, in the present invention, the turbo refrigerator including the turbo compressor capable of preventing any collision of the liquid pooled in the flow path against the impeller is obtained.

Additionally, in the present invention, a configuration in which the fluid discharge device has a fluid discharge unit which communicates with a spot where the refrigerant has been discharged and whose internal atmospheric pressure is lower than that of the spot is adopted.

By adopting such a configuration, in the present invention, by making the liquid introduced into the fluid discharge unit by using a difference in atmospheric pressure, it is not necessary to provide a separate pump, and the like, and it is possible to contribute to realizing low cost.

Additionally, in the present invention, a configuration in which the fluid discharge device has a fluid discharge unit which communicates with a spot to which the refrigerant has been discharged and which is provided below the spot is adopted.

By adopting such a configuration, in the present invention, by making the refrigerant introduced into the fluid discharge unit by using a difference in height, it is not necessary to provide a separate pump, and the like, and it is possible to contribute to realizing low cost.

Additionally, in the present invention, a configuration in which the fluid discharge unit is the evaporator is adopted.

By adopting such a configuration, in the present invention, the refrigerant which has been discharged and removed from the flow path can be reused without being discarded.

According to the present invention, in a turbo compressor including an impeller which is rotationally driven, and a flow path in which the impeller is provided, and through which gas flows, and sucking and compressing the gas in the flow path, a configuration in which the turbo compressor includes a fluid discharge device which discharges a liquid in the flow path on the upstream side of the impeller is adopted. By adopting such a configuration, the liquid is discharged and removed in advance in the upstream flow path which leads to the impeller, and thereby, any collision of the liquid pooled in the flow path against the impeller can be prevented.

Accordingly, it is possible to provide a turbo compressor capable of preventing fatigue breaking of an impeller and controlling degradation of the compression performance of the impeller.

DETAILED DESCRIPTION OF THE INVENTION

Hereinafter, an embodiment of the present invention will be described with reference to the drawings.

Figure 1:
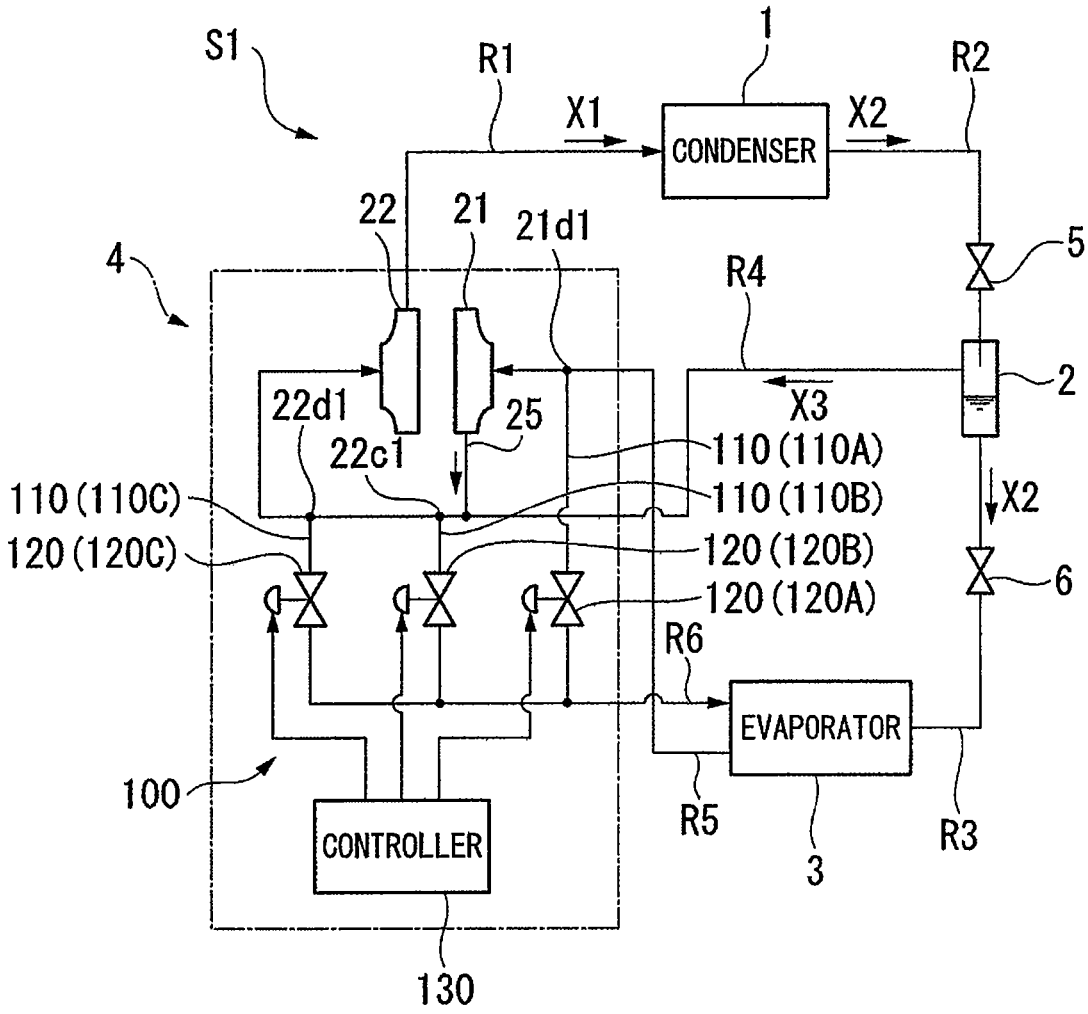
FIG. 1 is a block diagram showing a schematic configuration of a turbo refrigerator in an embodiment of the present invention.

FIG. 1 is a block diagram showing a schematic configuration of a turbo refrigerator (refrigerator) S1 in this embodiment.

The turbo refrigerator S1 in this embodiment is installed in buildings or factories in order to generate, for example, cooling water for air conditioning. As shown in FIG. 1, the turbo refrigerator S1 includes a condenser 1, an economizer 2, an evaporator (fluid discharge unit) 3, and a turbo compressor 4.

In the condenser 1, a compressed refrigerant gas X1 that is a refrigerant compressed in a gaseous state is supplied thereto, and the compressed refrigerant gas X1 is cooled and liquefied to form a refrigerant fluid X2. The condenser 1, as shown in FIG. 1, is connected to the turbo compressor 4 via a pipe R1 through which the compressed refrigerant gas X1 flows, and is connected to the economizer 2 via a pipe R2 through which the refrigerant fluid X2 flows. In addition, an expansion valve 5 for decompressing the refrigerant fluid X2 is installed in the pipe R2.

The economizer 2 temporarily stores the refrigerant fluid X2 decompressed in the expansion valve 5. The economizer 2 is connected to the evaporator 3 via a pipe R3 through which the refrigerant fluid X2 flows. Additionally, the economizer 2 is connected to the turbo compressor 4 via a pipe R4 through which a gaseous refrigerant X3 generated in the economizer 2 flows. In addition, an expansion valve 6 for further decompressing the refrigerant fluid X2 is installed in the pipe R3. Additionally, the pipe R4 is connected to the turbo compressor 4, and allows the gaseous refrigerant X3 to be supplied to a second compression stage 22 (to be described later) included in the turbo compressor 4.

The evaporator 3 evaporates the refrigerant fluid X2 to remove vaporization heat from an object to be cooled, such as water, thereby cooling an object to be cooled. The evaporator 3 is connected to the turbo compressor 4 via a pipe R5 through which a refrigerant gas X4 generated as the refrigerant fluid X2 is evaporated flows. In addition, the pipe R5 is connected to a first compression stage 21 included in the turbo compressor 4. Additionally, the evaporator 3 is arranged below the turbo compressor 4. The evaporator 3 is connected via a pipe R6 to a fluid discharge device 100 which will be described later.

The turbo compressor 4 compresses the refrigerant gas X4 to generate the compressed refrigerant gas X1. The turbo compressor 4 is connected to the condenser 1 via the pipe R1 through which compressed refrigerant gas X1 flows as described above. The turbo compressor 4 is connected to the evaporator 3 via the pipe R5 through which the refrigerant gas X4 flows.

In the turbo refrigerator S1 configured in this way, the compressed refrigerant gas X1 supplied to the condenser 1 via the pipe R1 is cooled and liquefied into the refrigerant fluid X2 by the condenser 1.

When the refrigerant fluid X2 is supplied to the economizer 2 via the pipe R2, the refrigerant fluid is decompressed by the expansion valve 5. The refrigerant fluid X2 is temporarily stored in the economizer 2 in a decompressed state. Thereafter, when the refrigerant fluid X2 is supplied to the evaporator 3 via the pipe R3, the refrigerant gas is further decompressed by the expansion valve 6. The refrigerant fluid X2 is supplied to the evaporator 3 in a further decompressed state.

The refrigerant fluid X2 supplied to the evaporator 3 is evaporated into the refrigerant gas X4 by the evaporator 3, and is supplied to the turbo compressor 4 via the pipe R5.

The refrigerant gas X4 supplied to the turbo compressor 4 is compressed into the compressed refrigerant gas X1 by the turbo compressor 4, and is supplied again to the condenser 1 via the pipe R1.

In addition, the gaseous refrigerant X3 generated when the refrigerant fluid X2 is stored in the economizer 2 is supplied to the turbo compressor 4 via the pipe R4. The gaseous refrigerant X3 is compressed into the compressed refrigerant gas X1 along with the refrigerant gas X4, and is supplied to the condenser 1 via the pipe R1.

In such a turbo refrigerator S1, when the refrigerant fluid X2 evaporates in the evaporator 3, an object to be cooled is cooled or refrigerated by depriving vaporization heat from the object to be cooled.

Subsequently, the turbo compressor 4 that is a characterizing portion of this embodiment will be described in more detail.

Figure 2:
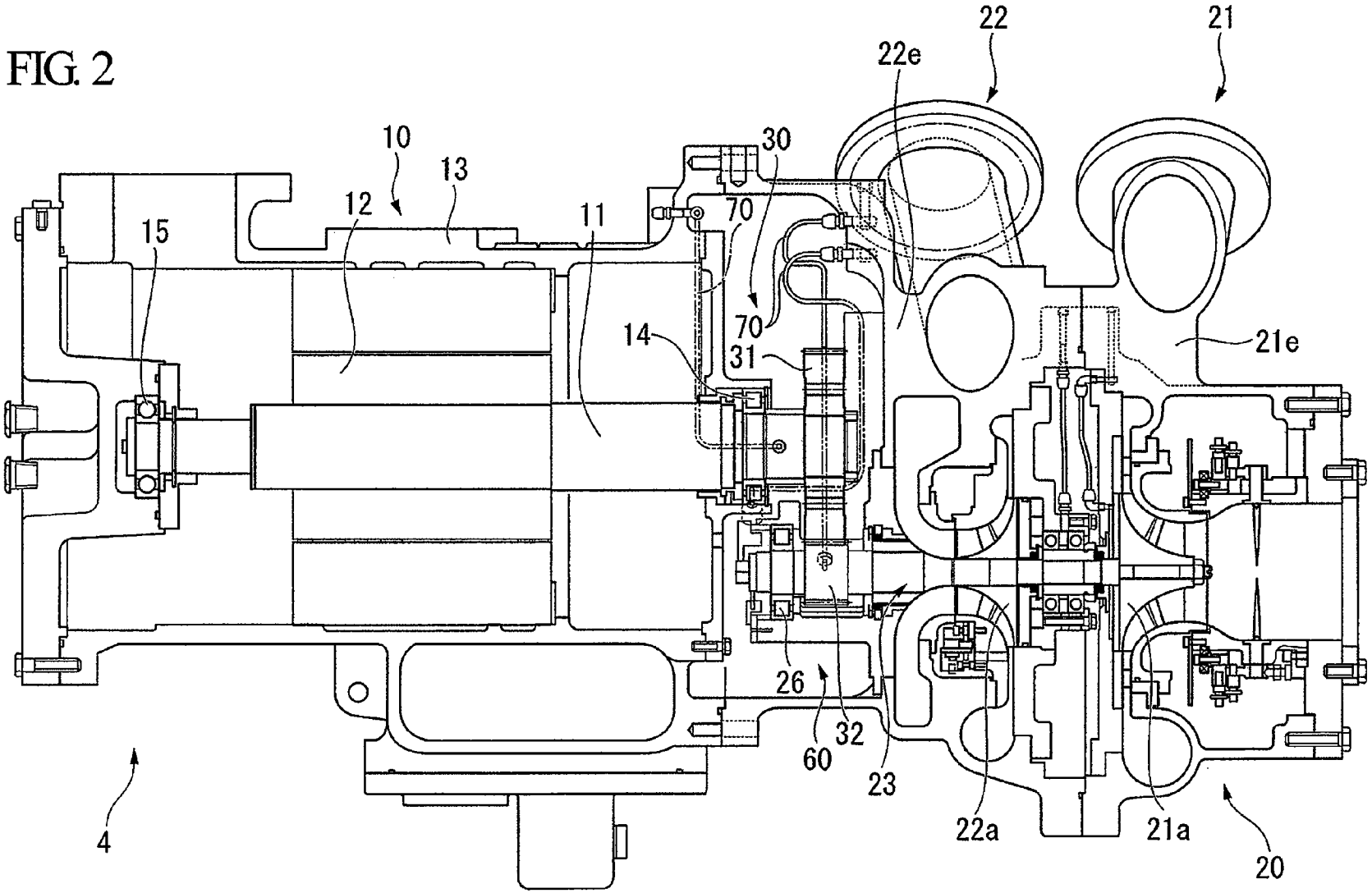
FIG. 2 is a horizontal sectional view of a turbo compressor included in the turbo refrigerator in the embodiment of the present invention.

FIG. 2 is a horizontal sectional view of the turbo compressor 4.

Figure 3:
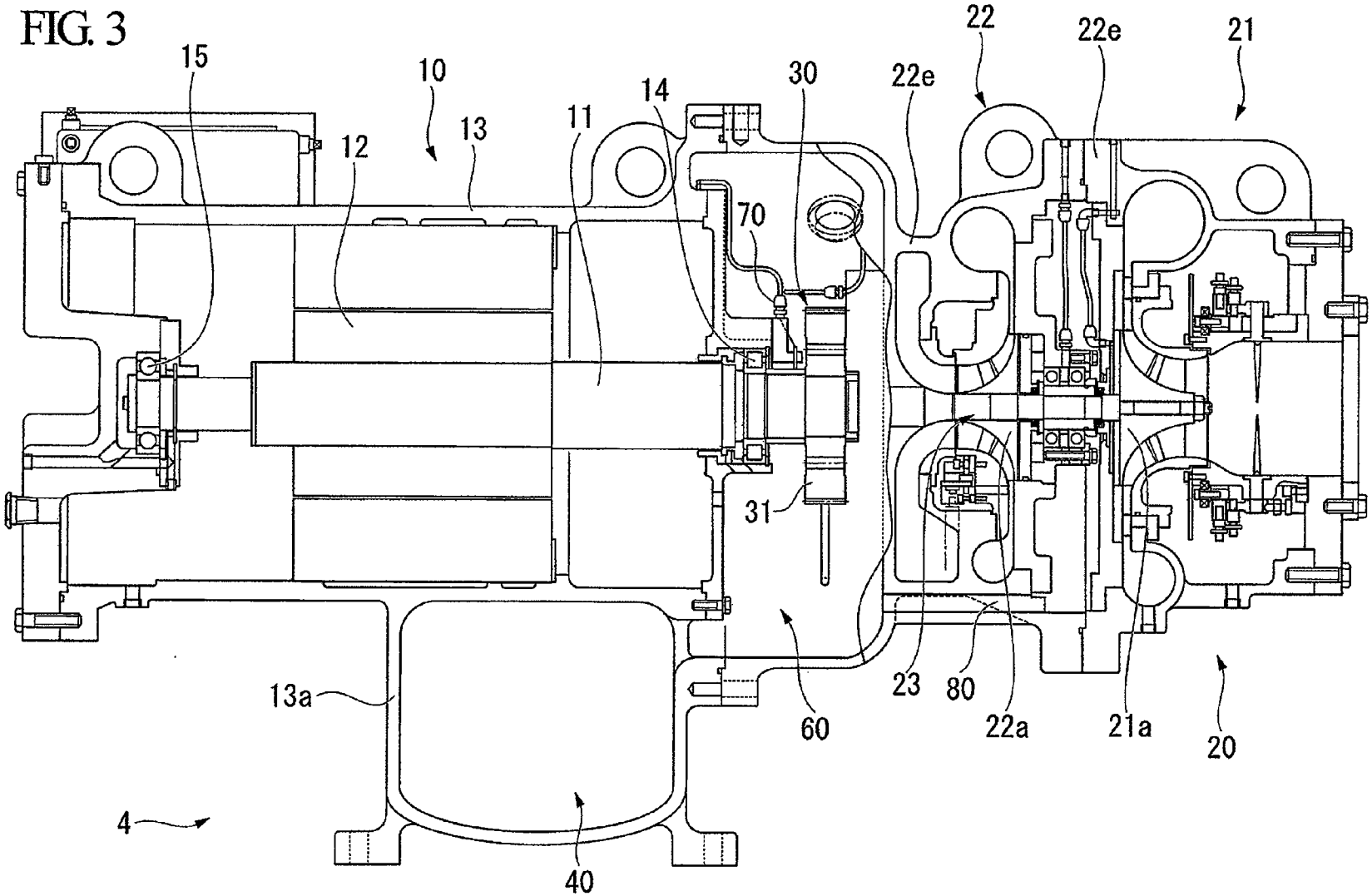
FIG. 3 is a vertical sectional view of the turbo compressor included in the turbo refrigerator in the embodiment of the present invention.

FIG. 3 is a vertical sectional view of the turbo compressor 4.

Figure 4:
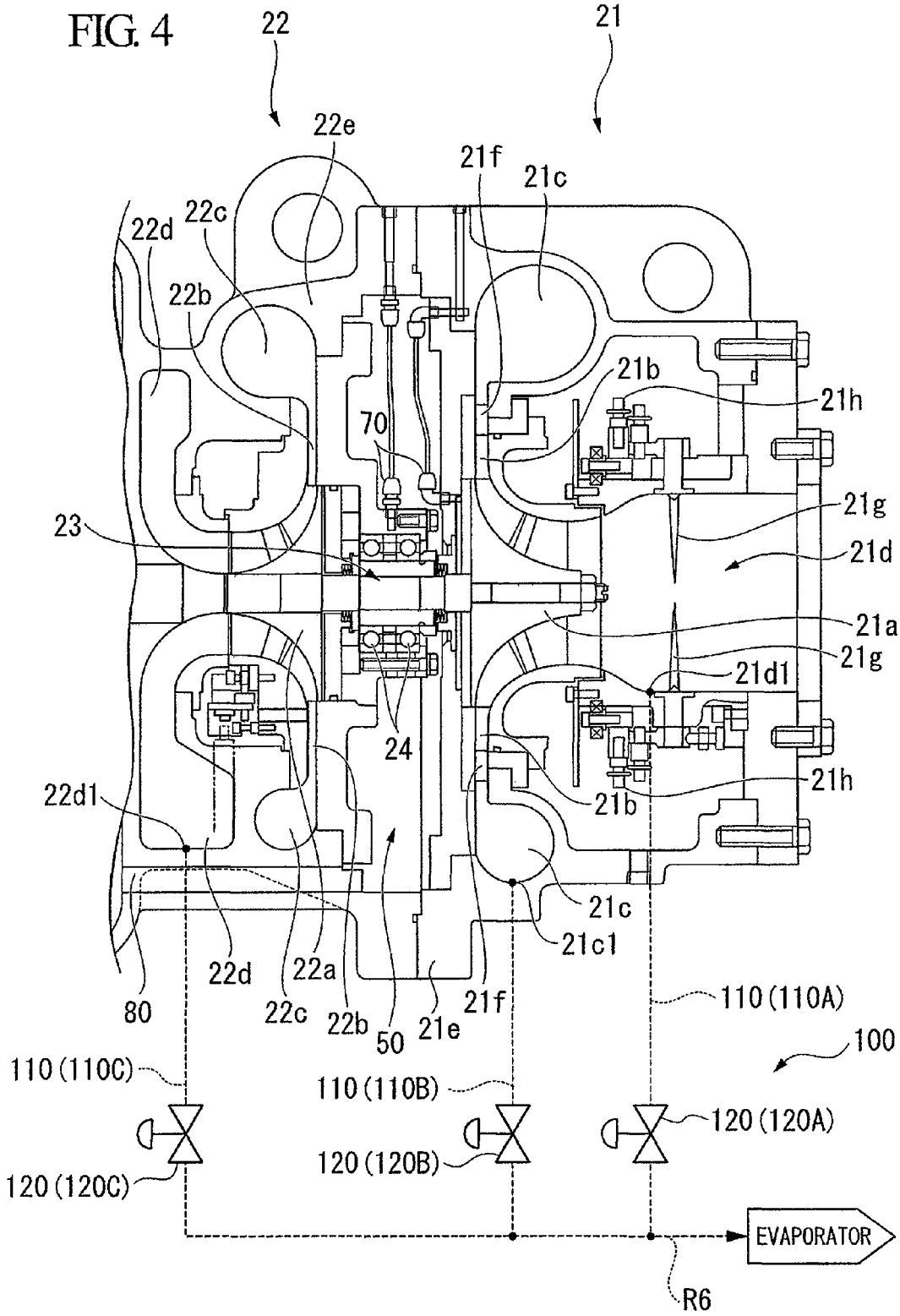
FIG. 4 is an enlarged vertical sectional view of a compressor unit included in the turbo compressor in the embodiment of the present invention.

FIG. 4 is an enlarged vertical sectional view of a compressor unit 20 included in the turbo compressor 4.

As shown in these drawings, the turbo compressor 4 in this embodiment includes a motor unit 10, a compressor unit 20, a gear unit 30, and the fluid discharge device 100 (refer to FIGS. 1 and 4).

As shown in FIGS. 2 and 3, the motor unit 10 includes a motor 12 which has an output shaft 11 and is a driving source for driving the compressor unit 20, and a motor housing 13 which surrounds the motor 12 and supports the motor 12.

In addition, the output shaft 11 of the motor 12 is rotatably supported by a first bearing 14 and a second bearing 15 which are fixed to the motor housing 13. Additionally, the motor housing 13 includes a leg portion 13*a* which supports the turbo compressor 4. The inside of the leg portion 13*a* is hollow, and is used as the oil tank 40. The lubricant supplied to sliding parts of the turbo compressor 4 is recovered and stored in the oil tank 40.

The compressor unit 20, as shown in FIG. 1, forms a flow path through which the refrigerant gas X4 circulates, and compresses the refrigerant gas X4 in multi-stages in this flow path. The compressor unit 20 includes the first compression stage 21 where the refrigerant gas X4 is sucked and compressed, and the second compression stage 22 where the refrigerant gas X4 compressed in the first compression stage 21 is further compressed and discharged as compressed refrigerant gas X1. Additionally, the first compression stage 21 and the second compression stage 22 are connected together by a connecting flow path (a second flow path) 25.

As shown in FIG. 4, the first compression stage 21 includes a first impeller (impeller) 21*a* which gives velocity energy to the refrigerant gas X4 to be supplied from a thrust direction, thereby discharging the refrigerant gas in a radial direction, a first diffuser 21*b* which converts the velocity energy given to the refrigerant gas X4 by the first impeller 21*a* into pressure energy, thereby compressing the refrigerant gas X4, a first scroll chamber 21*c* which guides the refrigerant gas X4 compressed by the first diffuser 21*b* to the outside of the first compression stage 21, and a suction port 21*d* which allows the refrigerant gas X4 to be sucked therethrough and supplied to the first impeller 21*a*.

In addition, the first diffuser 21*b*, the first scroll chamber 21*c*, and a portion of the suction port 21*d* are formed by a first housing 21*e* surrounding the first impeller 21*a*.

The first impeller 21*a* is fixed to a rotation shaft 23, and is rotationally driven as the rotation shaft 23 has rotative power transmitted thereto from the output shaft 11 of the motor 12 and is rotated.

The first diffuser 21*b* is annularly arranged around the first impeller 21*a*. In addition, in the turbo compressor 4 of this embodiment, the first diffuser 21*b* is a diffuser with vanes including a plurality of diffuser vanes 21*f* which reduces the turning speed of the refrigerant gas X4 in the first diffuser 21*b*, and efficiently converts velocity energy into pressure energy.

Additionally, a plurality of inlet guide vanes 21*g* for adjusting the suction capacity of the first compression stage 21 is installed in the suction port 21*d* of the first compression stage 21.

Each inlet guide vane 21*g* is rotatable by a driving mechanism 21*h* fixed to the first housing 21*e* so that its apparent area from a flow direction of the refrigerant gas X4 can be changed.

The second compression stage 22 includes a second impeller 22*a* which gives velocity energy to the refrigerant gas X4 compressed in the first compression stage 21 and supplied from the thrust direction, thereby discharging the refrigerant gas in the radial direction, a second diffuser 22*b* which converts the velocity energy given to the refrigerant gas X4 by the second impeller (impeller) 22*a* into pressure energy, thereby compressing the refrigerant gas X4 to discharge the refrigerant gas as the compressed refrigerant gas X1, a second scroll chamber 22*c* which guides the compressed refrigerant gas X1 discharged from the second diffuser 22*b* to the outside of the second compression stage 22, and an introducing scroll chamber 22*d* which introduces the refrigerant gas X4 compressed in the first compression stage 21 to the second impeller 22*a*.

In addition, the second diffuser 22*b*, the second scroll chamber 22*c*, and a portion of introducing scroll chamber 22*d* are formed by a second housing 22*e* surrounding the second impeller 22*a*.

The second impeller 22*a* is fixed to the rotation shaft 23 so as to face the first impeller 21*a* back to back. The second impeller 22*a* is rotationally driven as the rotation shaft 23 has rotative power transmitted thereto from the output shaft 11 of the motor 12 and is rotated.

The second diffuser 22*b* is annularly arranged around the second impeller 22*a*. In the turbo compressor 4 of this embodiment, the second diffuser 22*b* is a vaneless diffuser which does not include a diffuser vane which reduces the turning speed of the refrigerant gas X4 in the second diffuser 22*b*, and efficiently converts velocity energy into pressure energy.

The second scroll chamber 22*c* is connected to the pipe R1 for supplying the compressed refrigerant gas X1 to the condenser 1, and supplies the compressed refrigerant gas X1 drawn from the second compression stage 22 to the pipe R1.

Additionally, the first scroll chamber 21*c* and the introducing scroll chamber 22*d* which form a portion of the connecting flow path 25 are connected together by an external pipe (not shown) which is formed around a horizontal axis which extends in a right-left direction on a sheet plane of FIG. 4. The refrigerant gas X4 compressed in the first compression stage 21 is supplied to the second compression stage 22. Additionally, the first scroll chamber 21*c* and the introducing scroll chamber 22*d* are also similarly adapted to forms a flow path around the horizontal axis.

Additionally, the aforementioned flow path R4 (refer to FIG. 1) is connected to the external pipe in the connecting flow path 25, and the gaseous refrigerant X3 generated in the economizer 2 is supplied to the second compression stage 22 via the external pipe.

Additionally, the rotation shaft 23 is rotatably supported by a third bearing 24 fixed to the second housing 22*e* of the second compression stage 22, and a fourth bearing 26 (refer to FIG. 2) fixed to the second housing 22*e* on the side of the motor unit 10, in a space 50 between the first compression stage 21 and the second compression stage 22.

The gear unit 30, as shown in FIG. 2, transmits the rotative power of the output shaft 11 of the motor 12 to the rotation shaft 23. The gear unit 30 is housed in a space 60 formed by the motor housing 13 of the motor unit 10, and the second housing 22*e* of the compressor unit 20.

The gear unit 30 is comprised of a large-diameter gear 31 fixed to the output shaft 11 of the motor 12, and a small-diameter gear 32 which is fixed to the rotation shaft 23, and meshes with the large-diameter gear 31, and the rotative power of the output shaft 11 of the motor 12 is transmitted to the rotation shaft 23 so that the rotation number of the rotation shaft 23 may increase with an increase in the rotation number of the output shaft 11.

Additionally, the turbo compressor 4 includes a lubricant-supplying device 70 which supplies lubricant stored in the oil tank 40 to bearings (the first bearing 14, the second bearing 15, the third bearing 24, and the fourth bearing 26), to between an impeller (the first impeller 21*a*, or the second impeller 22*a*) and a housing (the first housing 21*e* or the second housing 22*e*), and to sliding parts, such as the gear unit 30. In addition, only a portion of the lubricant-supplying device 70 is shown in the drawing.

In addition, the space 50 where the third bearing 24 is arranged and the space 60 where the gear unit 30 is housed are connected together by a through-hole 80 formed in the second housing 22*e*. The space 60 and the oil tank 40 are connected together. For this reason, the lubricant which is supplied to spaces 50 and 60, and flows down from the sliding parts is recovered to the oil tank 40.

Subsequently, the configuration of the fluid discharge device 100 which discharges a liquid pooled in the turbo compressor 4 will be described. The fluid discharge device 100 discharges a liquid in a flow path on the upstream side of the first impeller 21*a* and the second impeller 22*a*. As shown in FIG. 1, the fluid discharge device 100 has fluid discharge pipes 110 through which a discharge fluid circulates, electromagnetic valves 120 connected to the fluid discharge pipes 110, and a controller 130 which open and close the electromagnetic valves 120.

The fluid discharge pipes 110 form discharge fluid flow paths through which a liquid pooled in the turbo compressor 4 is sucked and discharged, and are connected to positions (for example, positions in which cavities are formed) where a liquid tends to pool.

In this embodiment, as shown in FIG. 4, a fluid discharge pipe 110A is connected to a suction port bottom 21*d*1 (liquid discharge port) of the suction port 21*d* (flow passageway) on the upstream side of the first impeller 21*a*, a fluid discharge pipe 110B is connected to a first scroll chamber bottom 21*c*1 (second liquid discharge port) of a first scroll chamber 21*c* (second flow passageway) on the upstream side of the second impeller 22*a*, and a fluid discharge pipe 110C is connected to an introducing scroll chamber bottom 22*d*1 (liquid discharge port) of the introducing scroll chamber 22*d* (flow passageway) on the upstream side of the second impeller 22*a*. The fluid discharge pipes 110 form discharge fluid flow paths, which extend downward from connecting portions thereof, respectively. Tips of the discharge fluid flow paths communicate with the pipe R6, respectively, and a discharge fluid flows together at the pipe R6.

In addition, as shown in FIG. 1, the pipe R6 is connected to an evaporator 3, and is adapted to form a discharge fluid flow path which is inclined to reach the evaporator 3.

The electromagnetic valves 120 limit the flow of a fluid which circulates through the fluid discharge pipes 110. The electromagnetic valves 120 are adapted to make solenoids inside thereof movable by ON/OFF of an electric current, thereby performing opening/closing of the discharge fluid flow paths. Additionally, the electromagnetic valves 120 close the discharge fluid flow paths of the fluid discharge pipes 110 in a normal state, and open the discharge fluid flow paths while an electric current flows. Also, the fluid discharge pipe 110A is provided with the electromagnetic valve 120A, the fluid discharge pipe 110B is provided with the electromagnetic valve 120B, and the fluid discharge pipe 110C is provided with the electromagnetic valve 120C.

The controller 130 (not shown in FIG. 4) controls opening/closing of the electromagnetic valves 120. The controller 130, as shown in FIG. 1, is electrically connected to the electromagnetic valves 120A to 120C, respectively, and is adapted to perform the control of making the electromagnetic valves 120A to 120C open or close by ON/OFF of an electric current.

Next, the operation at the time of starting of the turbo compressor 4 in this embodiment configured in this way will be described with reference to FIG. 5.

Figure 5:
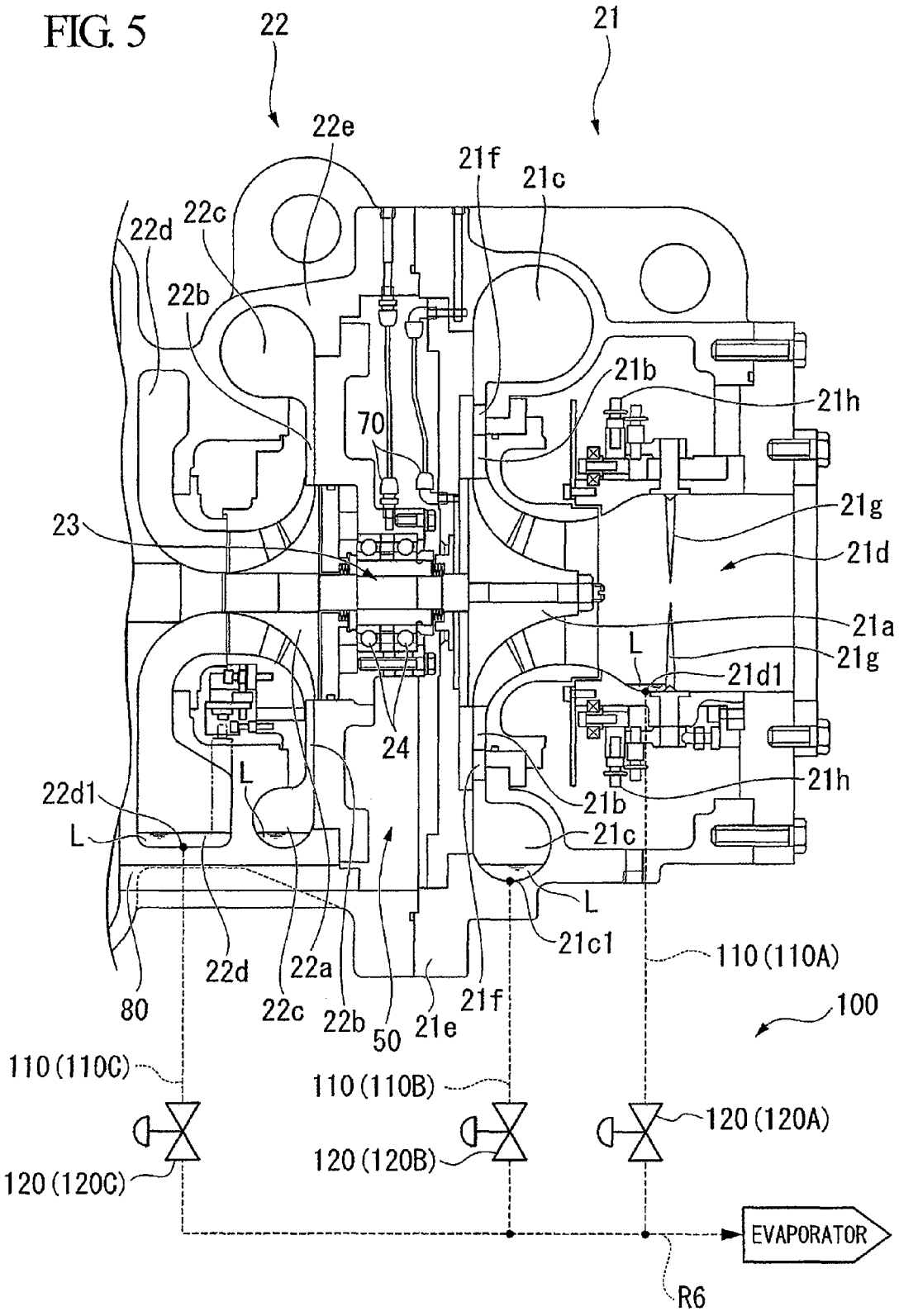
FIG. 5 shows a state at the time of starting of the turbo compressor in the embodiment of the present invention.

FIG. 5 is a view showing a state at the time of starting of the turbo compressor 4.

In the turbo compressor 4, as shown in FIG. 5, the refrigerant gas X4 filled into the turbo compressor 4 liquefies according to the conditions of outside air temperature during standby. Also, a liquid L forms a liquid pool at the bottom of a flow path through which the refrigerant gas X4 circulates. In FIG. 5, the liquid L forms liquid pools at the bottoms of the suction port 21*d*, the first scroll chamber 21*c*, the introducing scroll chamber 22*d*, and the second scroll chamber 22*c*.

The turbo compressor 4 which has received a starting signal by a user first operates the lubricant-supplying device 70 and the fluid discharge device 100.

As shown in FIG. 2, the lubricant-supplying device 70 supplies lubricant to each sliding part of the turbo compressor 4 from the oil tank 40, and provides driving of the motor 12. The motor 12 is driven after this oil feeding operation at the time of starting is ended. The rotative power of the output shaft 11 of the motor 12 is transmitted to the rotation shaft 23 via the gear unit 30. Hence, the first impeller 21*a* and the second impeller 22*a* of the compressor unit 20 which are shown in the FIG. 5 are rotationally driven.

Accordingly, the fluid discharge device 100 prevents the liquid L which forms a liquid pool from being sucked by this rotational driving, and colliding against the first impeller 21*a* and the second impeller 22*a*. In order to obtain this effect, the fluid discharge device 100 operates during the oil feeding operation at the time of starting by the lubricant-supplying device 70 before the first impeller 21*a* and the second impeller 22*a* are rotationally driven.

The controller 130 (not shown in FIG. 5, but refer to FIG. 1) which has received an actuating signal supplies an electric current to the electromagnetic valves 120A to 120C, respectively, and opens the discharge fluid flow paths of the fluid discharge pipes 110A to 110C for a certain period of time (for example, one minute to two minutes in the embodiment). At this time, the fluid discharge pipes 110A to 110C and the pipe 6R to which these pipes are connected are inclined downward to reach the evaporator 3.

Accordingly, by opening the discharge fluid flow paths to utilize a difference in height, the liquid L pooled in the suction port 21*d* is sucked from the suction port bottom 21*d*1, and is discharged out via the fluid discharge pipe 110A, the liquid L pooled in the first scroll chamber 21*c* is sucked from the first scroll chamber bottom 21*c*1, and is discharged out via the fluid discharge pipe 110B, and the liquid L pooled in the introducing scroll chamber 22*d* is sucked from the introducing scroll chamber bottom 22*d*1, and is discharged via the fluid discharge pipe 110C.

In addition, the discharged liquid L is reused after it flows together at the pipe R6, and is introduced into an evaporator 3 (refer to FIG. 1).

Also, the controller 130 stops supply of an electric current to the electromagnetic valves 120A to 120C, and closes the discharge fluid flow paths of the fluid discharge pipes 110A to 110C, respectively, after the liquid L has been discharged and a certain period of time has lapsed. By this operation, a series of fluid discharge operations of the fluid discharge device 100 is ended.

After the fluid discharge operation is ended, the turbo compressor 4 rotationally drives the first impeller 21*a* and the second impeller 22*a*, and compresses the refrigerant gas X4 which flows in from the suction port 21*d* in multi-stages by the operation of the first compression stage 21 and the second compression stage 22, thereby generating the compressed refrigerant gas X1, and supplies the refrigerant gas to the condenser 1 via the pipe R1 shown in FIG. 1. In addition, the liquid L pooled in the second scroll chamber 22*c* is delivered to the condenser 1 by the rotational driving of the second impeller 22*a*.For this reason, the liquid L does not collide against the first impeller 21*a* and the second impeller 22*a*, and does not need to be discharged by the fluid discharge device 100. However, a configuration in which a fluid is discharged even in this spot may be adopted.

Accordingly, in the above-described embodiment, a configuration is adopted in which the turbo compressor 4 which has the first impeller 21*a* and the second impeller 22*a* which are rotationally driven, and the flow paths in which the first impeller 21*a* and the second impeller 22*a* are provided and through which the refrigerant gas X4 flows, and sucks and compresses the refrigerant gas X4 of the flow paths, has the fluid discharge device 100 which discharges the liquid L of the flow paths on the upstream side of the first impeller 21*a* and the second impeller 22*a*. Hence, the liquid L is discharged and removed in advance in the upstream flow paths which lead to the first impeller 21*a* and the second impeller 22*a*. For this reason, any collision of the liquid L pooled in the flow paths against the first impeller 21*a* and the second impeller 22*a* can be prevented.

Accordingly, this embodiment has the effects capable of providing the turbo compressor 4 capable of preventing fatigue breaking of the first impeller 21*a* and the second impeller 22*a* and controlling degradation of the compression performance of these impellers.

Additionally, in this embodiment, a configuration in which the liquid L is the liquefied refrigerant gas X4 is adopted. Hence, the liquid L generated according to the conditions of outside air temperature can be discharged.

Additionally, in this embodiment, a configuration in which the fluid discharge device 100 has the fluid discharge pipes 110 which are connected to the flow paths and allow the liquid L to be discharged therethrough, the electromagnetic valves 120 connected to the fluid discharge pipes 110, and the controller 130 which opens and closes the electromagnetic valves 120 is adopted. Hence, the control of making the liquid L into a discharge fluid or non-discharge fluid by the fluid discharge pipes 110 by the opening/closing of the electromagnetic valves 120 can be performed.

Additionally, in this embodiment, a configuration in which the controller 130 opens the electromagnetic valves 120 before the first impeller 21*a* and the second impeller 22*a* are rotationally driven is adopted. Hence, the liquid L can be discharged to preferably prevent the liquid from colliding against the first impeller 21*a* and the second impeller 22*a* before the first impeller 21*a* and the second impeller 22*a* are rotationally driven to suck the liquid L.

In this embodiment, in order to compress the refrigerant gas X4 in multi-stages, a configuration is adopted in which the first compression stage 21 having the first impeller 21*a* and the second compression stage 22 having the second impeller 22*a* are provided, the connecting flow path 25 which connects the first compression stage 21 and the second compression stage 22 together and is formed around a horizontal axis is provided, and the fluid discharge pipe 110B and the fluid discharge pipe 110C which are provided in the first scroll chamber bottom 21*c*1 and the introducing scroll chamber bottoms 22*d*1 of the connecting flow path 25. Hence, the liquid L can be discharged from every position which becomes the bottom of the connecting flow path 25 formed around the horizontal axis where the liquid tends to pool. For this reason, any collision of the liquid L against the second impeller 22*a* can be prevented.

Additionally, in this embodiment, in a turbo refrigerator S1 including a condenser 1 which cools and liquefies a compressed refrigerant gas X1, an evaporator 3 which evaporates the refrigerant fluid X2 and deprives vaporization heat from an object to be cooled, thereby cooling the object to be cooled, and a compressor which compresses a refrigerant gas X4 evaporated in the evaporator 3 and supplies the refrigerant gas to the condenser 1, a configuration in which the turbo compressor 4 is used as the compressor is adopted. Hence, the turbo refrigerator S1 including the turbo compressor 4 capable of preventing any collision of the liquid L pooled in the flow paths against the first impeller 21*a* and the second impeller 22*a* is obtained.

Additionally, in this embodiment, a configuration in which the fluid discharge device 100 has a fluid discharge unit which communicates with a spot to which the liquid L has been discharged and is provided below the spot is adopted. Hence, by making the liquid L introduced into the fluid discharge unit by using a difference in height, it is not necessary to provide a separate pump, and the like, and it is possible to contribute to realizing low cost.

Additionally, in this embodiment, a configuration in which the fluid discharge unit is the evaporator 3 is adopted. Hence, the liquid L which has been discharged and removed from the flow paths can be reused without being discarded. Additionally, the evaporator 3 has an effect which is easy to introduce a discharge fluid since its internal atmospheric pressure is lower than that of the condenser 1, the economizer 2, or the like.

Although the preferred embodiment of the present invention has been described with reference to the accompanying drawings, the present invention is not limited to the above embodiment, and is only limited by the scope of the appended claims. Various shapes or combinations of respective constituent members illustrated in the above-described embodiments are merely examples, and various changes may be made depending on design requirements or the like without departing from the spirit or scope of the present invention.

For example, although this embodiment has described that discharged liquid L is introduced into the evaporator 3 provided below a spot where the liquid L has been discharged, the present invention is not limited to the above configuration.

For example, when the evaporator 3 is provided above the spot where the liquid L has been discharged, a configuration in which the liquid L is guided to the evaporator 3 by a difference in atmospheric pressure with the pressure of the evaporator 3 being made lower than that of the spot where the liquid L has been discharged may be adopted. Additionally, a configuration in which a separate pump is provided to carry the liquid L may be adopted. Additionally, a combined configuration of those configurations may be adopted.

Additionally, an introduction destination of the liquid L in the present invention is not limited to the evaporator 3, and may not be, for example, the condenser 1 or the economizer 2. Additionally, a fluid discharge unit which stores the liquid L may be provided separately. Even in this case, similarly to above, a configuration in which a discharge fluid is introduced by a difference in height, a difference in atmospheric pressure, or a pump is more preferably adopted.

Additionally, this embodiment has described that the fluid discharge device 100 operates at the time of starting of the turbo compressor 4. However, the fluid discharge device 100 of the present invention is not limited to a configuration in which fluid discharge operation is always performed according to starting of the turbo compressor 4. The fluid discharge device 100 of the present invention may has a configuration in which a sensor which determines whether or not any liquid L exists in a spot where the liquid L tends to pool is provided, and the fluid discharge operation is performed on the basis of detected results of the sensor. Additionally, a configuration in which whether or not the liquid L has been pooled in the turbo compressor 4 is estimated on the basis of the detected results of a temperature sensor which detects the temperature of ambient air, and the fluid discharge operation is performed may be adopted. Additionally, a configuration in which the standby time of the turbo compressor 4 is measured, it is determined that the liquid L has been pooled if the measured standby time exceeds a predetermined threshold value, and the fluid discharge operation is performed. Additionally, a combined configuration of those configurations may be adopted.

While preferred embodiments of the present invention have been described and illustrated above, it should be understood that these are exemplary of the present invention and are not to be considered as limiting. Additions, omissions, substitutions, and other modifications can be made without departing from the spirit or scope of the present invention. Accordingly, the present invention is not to be considered as being limited by the foregoing description, and is only limited by the scope of the appended claims.

What is claimed is:

1. A turbo compressor to suction and compress gas comprising:

a housing including a flow passageway through which gas flows, the gas liquefying when a certain ambient temperature is reached;

an impeller disposed inside the flow passageway of the housing, the impeller being configured to provide suction of the gas by being rotationally driven;

a liquid discharge port provided in the flow passageway on the upstream side of the impeller, the liquid discharge port being configured to discharge, from the flow passageway, any liquid produced as the gas liquefies when the turbo compressor is stopped;

a liquid discharge pipe connected to the liquid discharge port of the flow passageway, the liquid discharge pipe being configured to allow the liquid to be discharged therethrough, an electromagnetic valve connected to the liquid discharge pipe, and a controller configured to open and close the electromagnetic valve, wherein the controller is configured to open the electromagnetic valve before the impeller is rotationally driven.

2. The turbo compressor according to claim 1, further comprising:

a rotation shaft to which the impeller is fixed, the rotation shaft extending in a horizontal direction, wherein the flow passageway of the housing is formed around the rotation shaft, and the liquid discharge port is provided at a bottom part of the flow passageway.

3. The turbo compressor according to claim 1, further comprising:

first and second compression stages each including an impeller;

a rotation shaft connecting the impeller of the first compression stage and the impeller of the second compression stage to each other, the rotation shaft extending in a horizontal direction;

a second flow passageway connecting the first and second compression stages, the second flow passageway being formed around the rotation shaft, and the second flow passageway being configured to allow the gas to flow therethrough; and a second liquid discharge port provided at a bottom part of the second flow passageway, the second liquid discharge port being configured to discharge, from the second flow passageway, any liquid produced as the gas liquefies when the turbo compressor is stopped.

4. A refrigerator comprising:

a condenser configured to cool and liquefy a compressed refrigerant gas, so as to produce a refrigerant liquid;

an evaporator configured to absorb vaporization heat by evaporating the refrigerant liquid produced at the condenser; and a turbo compressor configured to compress the refrigerant gas produced at the evaporator and to supply the refrigerant gas to the condenser, wherein the turbo compressor includes:

a housing including a flow passageway through which the refrigerant gas flows, the refrigerant gas liquefying when a certain ambient temperature is reached, an impeller disposed inside the flow passageway of the housing, the impeller being configured to provide suction of the refrigerant gas by being rotationally driven, and a liquid discharge port provided in the flow passageway on the upstream side of the impeller, the liquid discharge port being configured to discharge, from the flow passageway, any liquid produced as the refrigerant gas liquefies when the turbo compressor is stopped, a liquid discharge pipe connected to the liquid discharge port of the flow passageway, the liquid discharge pipe being configured to allow the liquid to be discharged therethrough, an electromagnetic valve connected to the liquid discharge pipe, and a controller configured to open and close the electromagnetic valve, wherein the controller is configured to open the electromagnetic valve before the impeller is rotationally driven.

5. The refrigerator according to claim 4, further comprising a liquid discharge unit communicated with the liquid discharge port, the liquid discharge unit being configured to allow the discharged liquid to be supplied thereto, wherein an internal atmospheric pressure of the liquid discharge unit is set to be lower than that of the liquid discharge port.

6. The refrigerator according to claim 4, further comprising a liquid discharge unit communicated with the liquid discharge port, the liquid discharge unit being configured to allow the discharged liquid to be supplied thereto, wherein the liquid discharge unit is provided below the liquid discharge port.

7. The refrigerator according to claim 4, wherein the evaporator is communicated with the liquid discharge port, and the evaporator is configured to allow the discharged liquid to be supplied thereto, and an internal atmospheric pressure of the evaporator is set to be lower than that of the liquid discharge port.

8. The refrigerator according to claim 4, wherein the evaporator is communicated with the liquid discharge port, and the evaporator is configured to allow the discharged liquid to be supplied thereto, and the evaporator is provided below the liquid discharge port.

* * * * *